US006881122B2

(12) United States Patent
Bloch et al.

(10) Patent No.: US 6,881,122 B2
(45) Date of Patent: Apr. 19, 2005

(54) TOY VEHICLE

(75) Inventors: Nathan Bloch, Cherry Hill, NJ (US); Vikas Kumar Parkhie Sinha, Philadelphia, PA (US); Justin Discoe, Windsor, CO (US); Kenlip Ong, Singapore (SG); Gregory Nungester, Titusville, NJ (US); Bruce Gavins, Mt. Laurel, NJ (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/850,651

(22) Filed: May 21, 2004

(65) Prior Publication Data

US 2005/0014447 A1 Jan. 20, 2005

Related U.S. Application Data

(60) Provisional application No. 60/472,849, filed on May 23, 2003.

(51) Int. Cl.[7] ..... A63H 17/26

(52) U.S. Cl. ..... 446/466; 446/437; 446/457; 446/454

(58) Field of Search ..... 446/437, 441, 446/442, 448, 436, 454, 457, 458, 461, 465, 466, 470

(56) References Cited

U.S. PATENT DOCUMENTS

| | | | | | |
|---|---|---|---|---|---|
| 5,334,077 | A | * | 8/1994 | Bailey | 446/466 |
| 5,618,219 | A | * | 4/1997 | Simone et al. | 446/456 |
| 6,565,409 | B1 | * | 5/2003 | Isogai | 446/437 |
| 6,764,376 | B1 | * | 7/2004 | Agostini et al. | 446/466 |
| 6,793,555 | B1 | * | 9/2004 | Tilbor et al. | 446/456 |

FOREIGN PATENT DOCUMENTS

| | | | | | |
|---|---|---|---|---|---|
| GB | 2033766 | A | * | 5/1980 | A63H/17/02 |
| JP | 01066787 | A | * | 3/1989 | G06F/15/70 |

* cited by examiner

*Primary Examiner*—Bena B. Miller
(74) *Attorney, Agent, or Firm*—Akin Gump Strauss Hauer & Feld, LLP

(57) ABSTRACT

A toy vehicle comprises a lift mechanism which allows the toy vehicle to be lifted from a supporting surface in a lifting motion. The lift mechanism includes a rotary member which engages a lifting lever hingedly attached to a chassis of the toy vehicle. In operation, the rotary member is abruptly moved by a biasing member into engagement with the lifting lever. The rotary member moves the lifting lever into an extended position, causing the lifting lever to engage the supporting surface, to lift the toy. The toy vehicle includes features to help permit operation of the lift mechanism only when the toy vehicle is in a proper operational condition.

18 Claims, 9 Drawing Sheets

TOY VEHICLE

CROSS-REFERENCE TO RELATED APPLICATIONS

This application claims benefit of U.S. Provisional Patent Application 60/472,849, "Toy Vehicle", filed May 23, 2003, which is entirely incorporated by reference herein.

BACKGROUND OF THE INVENTION

The present invention relates generally to toy vehicles and, more particularly, to remote control toy vehicles capable of "jumping" or lifting off of a surface upon which the vehicle is traveling.

Toy vehicles are known which include a mechanism for elevating or lifting the vehicle during normal operation. For example, the prior art includes Japanese Patent Publication Number 10-066787 ("JP 10-066787"), which discloses a toy vehicle with a jumping mechanism. As illustrated in FIG. 7 of JP 10-066787, the toy vehicle of that invention is capable of executing only a simple linear jumping motion. Furthermore, the toy vehicle of JP 10-066787 does not disclose safety features which prevent operation of the jumping mechanism when the toy vehicle is not in a safe operating condition. It is believed that a new toy vehicle design having both an unusual lifting action as well as safety features to help prevent hazardous operation of the lift mechanism would be desirable.

BRIEF SUMMARY OF THE INVENTION

Briefly stated, in a presently preferred embodiment, the invention is a toy vehicle comprising: a vehicle chassis; a plurality of road wheels supporting the vehicle chassis for movement across a supporting surface; a power source supported by the vehicle chassis; a vehicle lift mechanism supported by the vehicle chassis and including: a rotary member; a lift motor operatively connected to the power source and to the rotary member; a lifting lever hingedly attached to the vehicle chassis, so as to pivot between a retracted position and an extended position; a first biasing member positioned to bias the lifting lever into the retracted position; and a second biasing member operably coupled to the rotary member; wherein the lift motor operatively engages with the rotary member to rotate the rotary member into a release position where the second biasing member causes the rotary member to move out of operative engagement with the lift motor and into operative engagement with the lifting lever, the second biasing member moving the lifting lever into the extended position through the rotary member, whereby the lifting lever engages the supporting surface and the toy vehicle is lifted away from the supporting surface in a lifting motion.

BRIEF DESCRIPTION OF THE SEVERAL VIEWS OF THE DRAWINGS

The following detailed description of a preferred embodiment of the invention will be better understood when read in conjunction with the appended drawings, some of which are diagrammatic. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
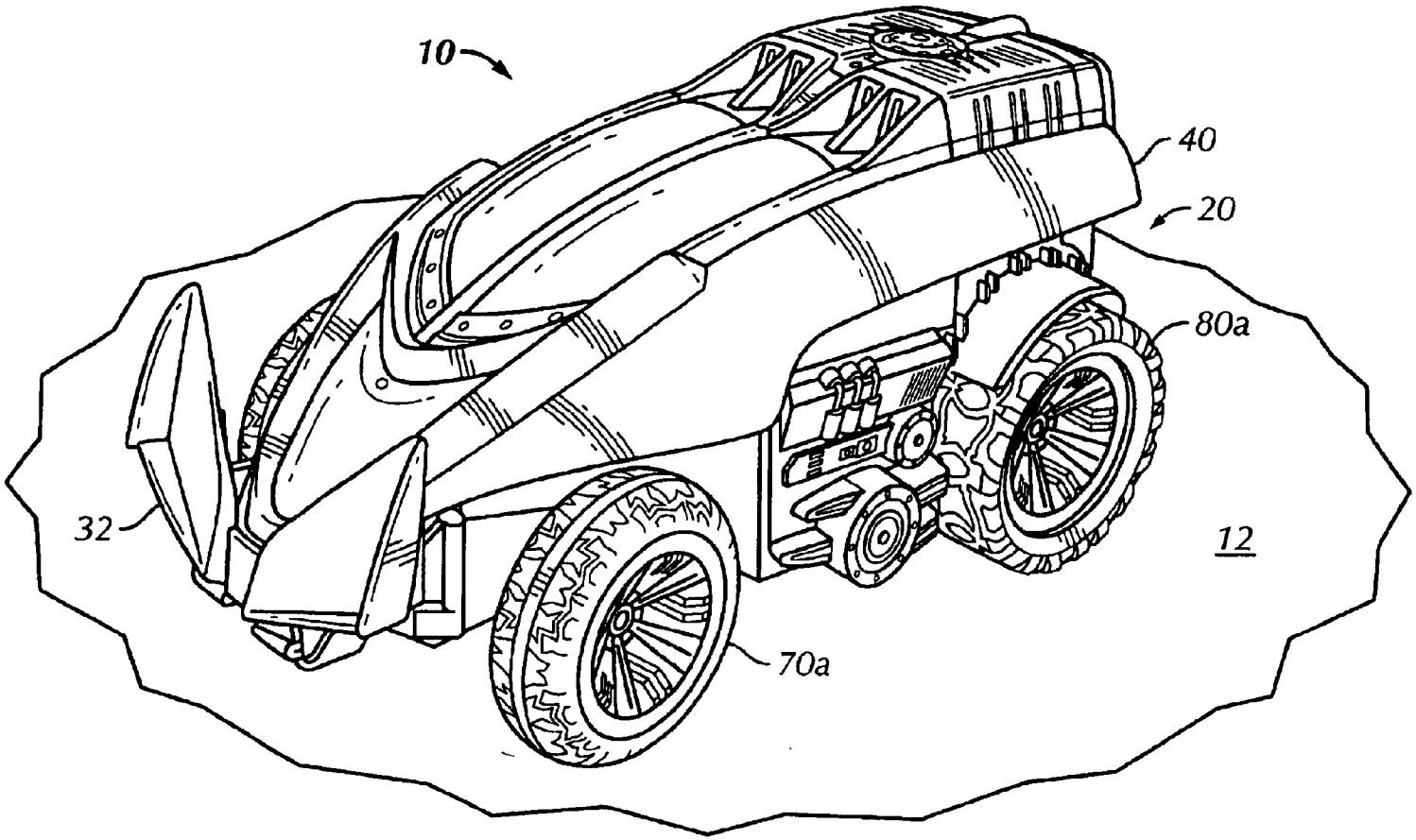
FIG. 1 is a side perspective view of one embodiment of the toy vehicle of the present invention.
Figure 2:
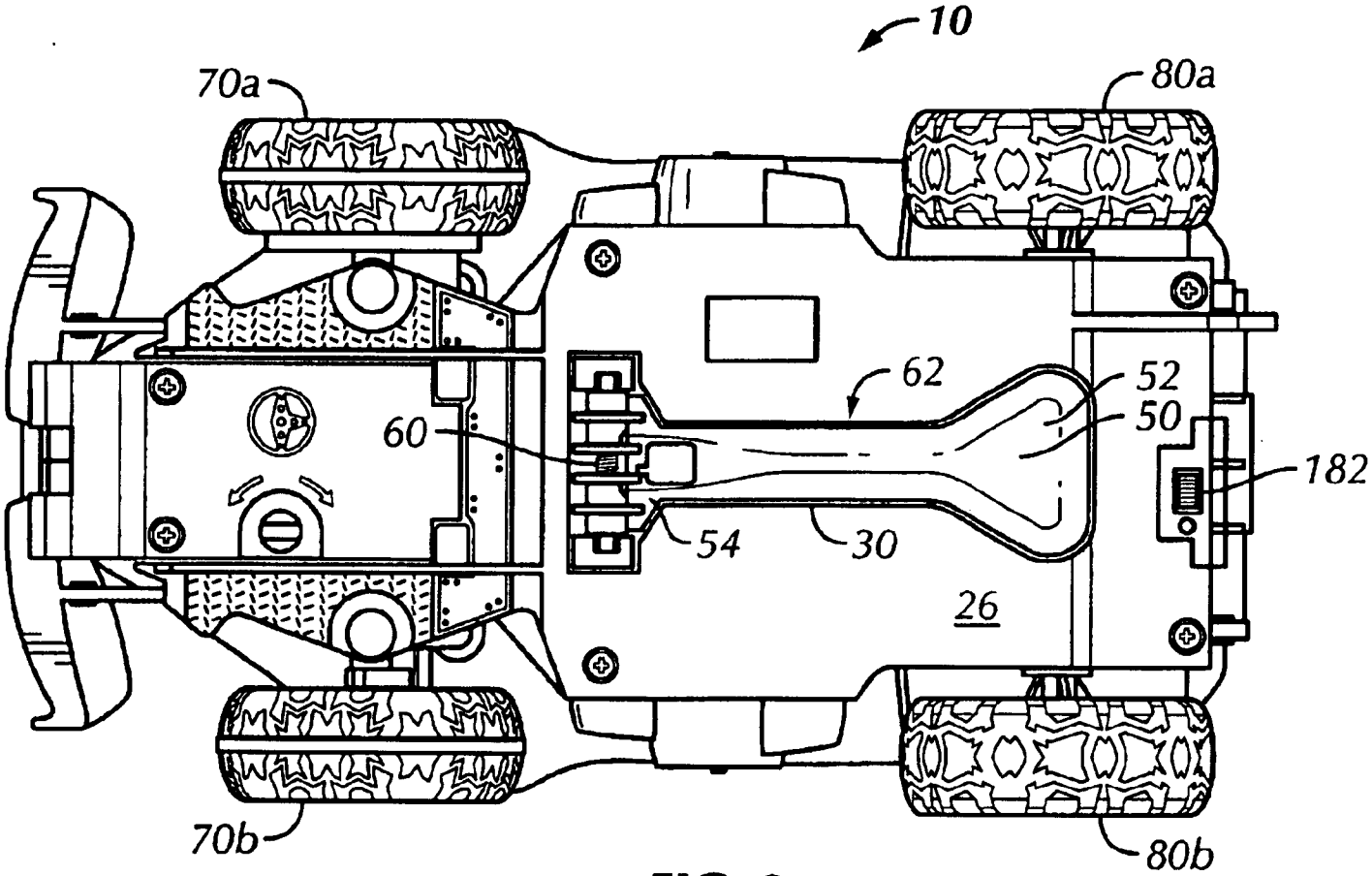
FIG. 2 is a bottom plan view of the toy vehicle of FIG. 1.

Certain terminology is used in the following description for convenience only and is not limiting. The words "lower" and "upper" designate directions in the drawings to which reference is made. The words "inwardly" and "outwardly" refer to directions toward and away from, respectively, the geometric center of the vehicle and designated parts thereof. The word "a" is defined to mean "at least one". The terminology includes the words above specifically mentioned, derivatives thereof and words of similar import. In the drawings, like numerals are used to indicate like elements throughout.

Referring to FIGS. 1–9, a preferred embodiment of a toy vehicle 10 of the present invention is disclosed. With particular reference to FIGS. 1–4, the toy vehicle 10 includes a vehicle chassis 20 formed from an upper housing 22 and a lower housing 24. A front bumper 32 is attached to a forward portion of the lower housing 24. Attached to the chassis 20 is a vehicle body 40. The upper housing 22 includes an anchor 34 by which a biasing member (such as a spring, as discussed below) may be attached to the upper housing 22.

A plurality of road wheels are supported by and, in turn, support the vehicle chassis 20 for movement across a supporting surface 12. In particular, a forward portion of the vehicle chassis 20 supports and is supported by at least one, and preferably two front wheels 70, including a left front wheel 70*a* and a right front wheel 70*b*. Similarly, a rear portion of the vehicle chassis 20 supports and is supported at least one, and preferably two rear wheels 80, including a left rear wheel 80*a* and a right rear wheel 80*b*. As seen particularly in FIG. 4, the front wheels 70 each include a front wheel hub 72 and a front tire 74. The left front wheel 70*a* further includes a wheel insert 76, which preferably has adjoining light and dark semi-circular portions as seen from an interior side of the wheel insert 76. Operation of the wheel insert 76 is described later herein. The front hubs 72 are attached to left and right steering kingpins 100*a* and 100*b*, respectively. The kingpins 100 include a top support pin 102, a bottom support pin 104 and a steering pivot pin 106. Similar to the front wheels 70, each rear wheel 80 includes a rear wheel hub 82 and a rear tire 84. The rear wheels 80 are connected to the chassis 20 by a rear axle 86.

A steering drive assembly is operably coupled to the front wheels 70 to provide powered steering control. The steering drive assembly is preferably a conventional design that includes a motor 92 and a gear box assembly 94, including a slip clutch and a steering gear train 96, housed within motor and gear box upper and lower housings 90*a* and 90*b*. A steering actuating lever 95 extends upward from the motor and gear box housing, and moves from side to side. The steering actuating lever 95 fits within a receptacle in a tie rod 98. The tie rod 98 is provided with holes at each opposing end. The steering pivot pins 106 fit within the holes. As the tie rod 98 moves side to side under the action of the steering actuating lever 95, the front wheels 70 are caused to turn as kingpins 100 are pivoted by steering pivot pins 106. One of ordinary skill in the art of toy vehicles will appreciate that any known steering assembly can be used with the present invention to provide steering control of the toy vehicle 10. For example, the vehicle does not even need to provide steering or may provide "tank" steering in which one or more wheels on each lateral side of the vehicle are separately and differently driven from the wheels in the other lateral side.

The toy vehicle 10 is preferably provided with a linear drive assembly including a linear drive motor 110. With continued reference to FIG. 4, the linear drive motor 110 is preferably supported at opposite ends by motor mount plates 112. The drive motor 110 is preferably a reversible electric motor of the type generally used in toy vehicles. The motor 10 is operatively coupled to the rear axle 86 through a linear drive gear train 116. The linear drive gear train 116 is operatively engaged with a pinion 114 affixed to an output shaft of the linear drive motor 110. Other drive train arrangements could be used such as belts or shafts or other forms of power transmission. The arrangement disclosed herein is not meant to be limiting.

Figure 3:
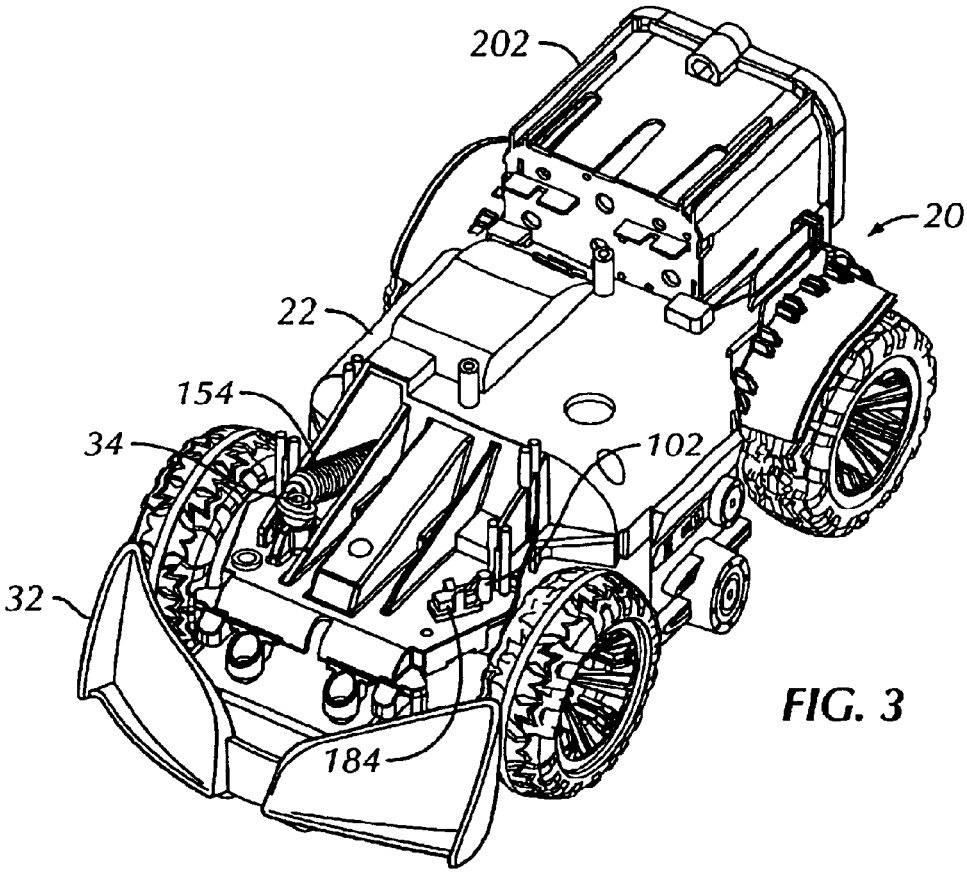
FIG. 3 is an upper perspective view of the toy vehicle of FIG. 1, shown with a vehicle body portion removed.
Figure 4:
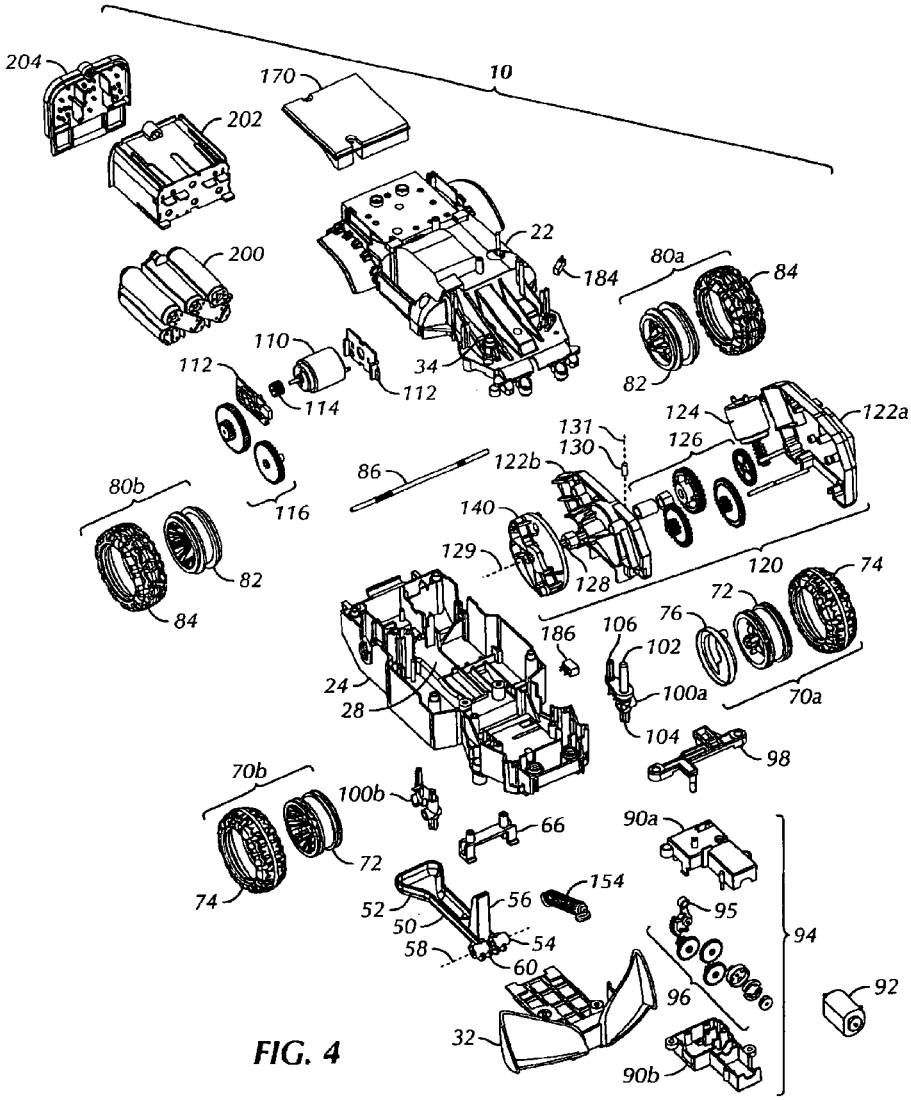
FIG. 4 is an exploded assembly view of the toy vehicle of FIG. 3.
Figure 9:
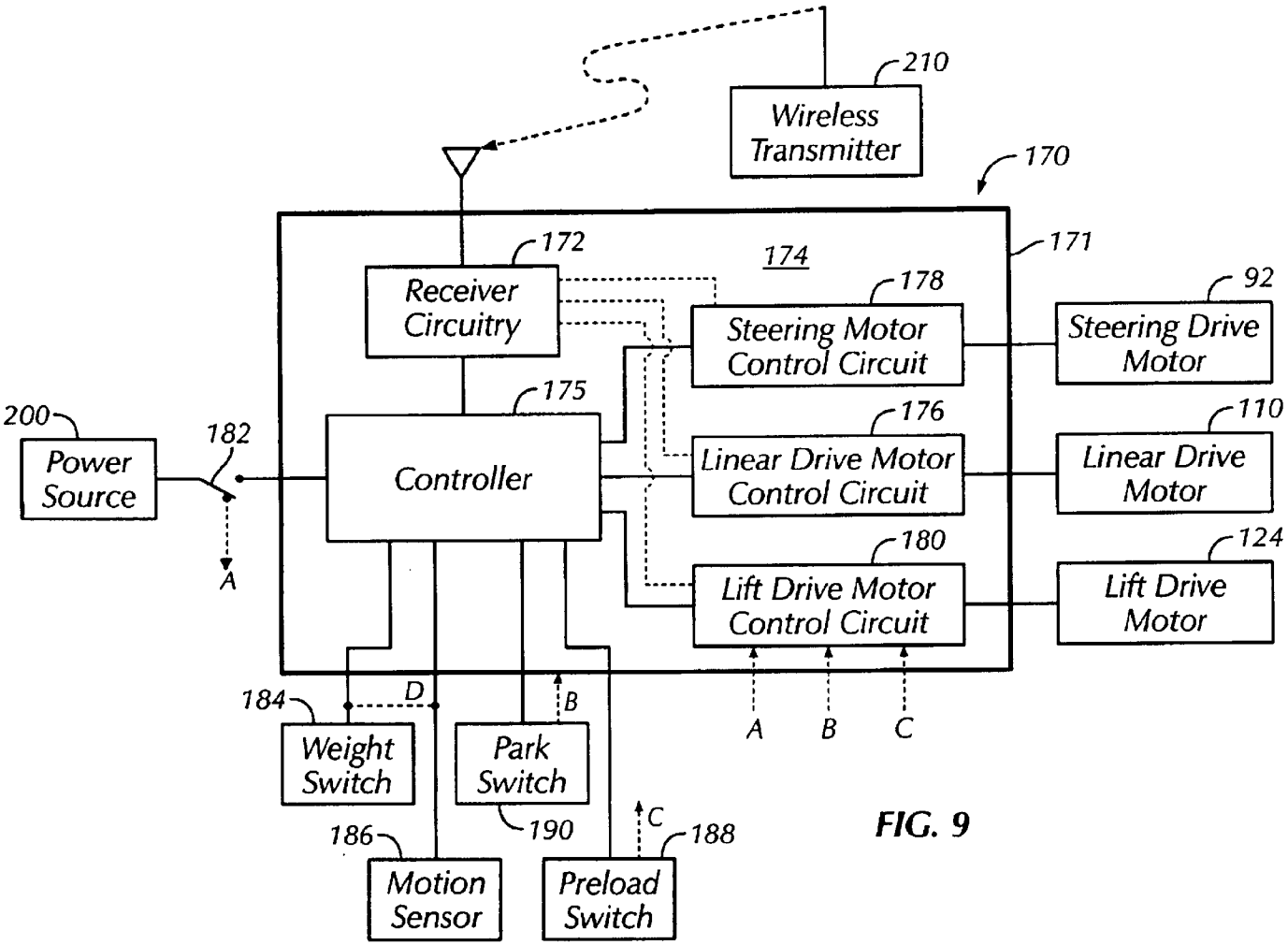
FIG. 9 is block diagram illustrating electronic and electromechanical components of the toy vehicle of FIG. 1.

The toy vehicle 10 further comprises a power source 200 supported by the vehicle chassis 20. Referring to FIGS. 3, 4 and 9, the power source 200 is preferably a set of conventional dry cell batteries housed in a battery box housing 202. A battery box housing door 204 allows a user access to the batteries. Alternatively, other sources of power could be provided, for example, a conventional rechargeable battery pack, solar cells, capacitive power supplies or other sources of electrical power and/or supported in or on or indirectly by the chassis.

The toy vehicle 10 further comprises a vehicle lift mechanism supported by the vehicle chassis 20. The lift mechanism includes a rotary assembly 120 and a lifting lever 50. The lifting lever 50 has a first end 52 and a second end 54. An actuating arm 56 extends generally perpendicularly from the second end 54. The lifting lever 50 is hingedly attached at second end 54 to the vehicle chassis 20, so as to pivot about a pivot axis 58 between a retracted position 62 in which it sits in a lower chassis lifting lever receptacle 30 (see FIGS. 2 and 6) and an extended position 64 (see FIG. 8). A first biasing member 60, preferably a torsion spring, is positioned to bias the lifting lever 50 into the retracted position 62. The lifting lever 50 is hinged to a lower chassis underside surface 26 the vehicle chassis 20 by suitable means such as a mounting bracket 66 attached to that surface with the actuating arm 56 extending through a hole 28 in the lower side of lower chassis housing 24 into the vehicle chassis 20.

The rotary assembly 120 includes a rotary member 140, a rotary member drive gearbox housing 122, formed by right and left gearbox housing half shells 122*a* and 122*b*, respectively, housing a gear train 126, a lift motor 124 operatively connected to the power source 200 and to the rotary member 140, through the gear train 126 and an output shaft 128 driven by the gear train 126.

Figure 5A:
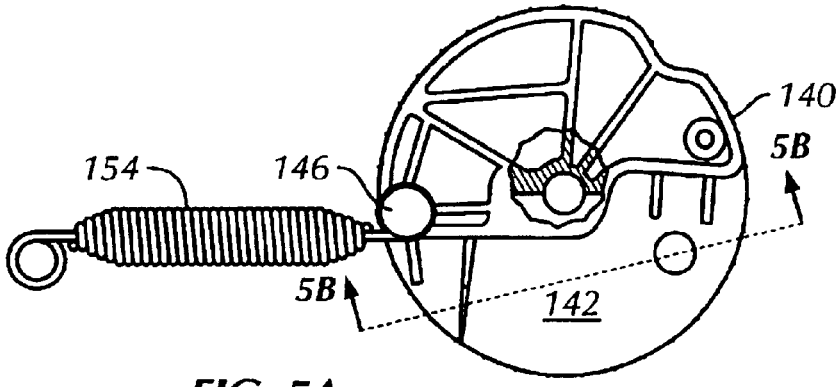
FIG. 5A is a side elevational view of a first side of a rotary member and a biasing member of a lift mechanism of the toy vehicle of FIG. 1.
Figure 5B:
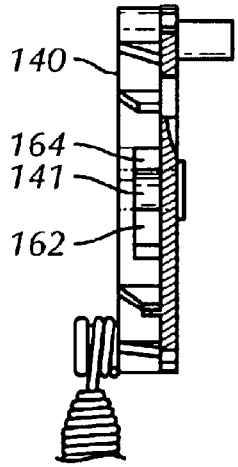
FIG. 5B is a sectional view of the rotary member of FIG. 5A, taken along line 5B—5B of FIG. 5A.
Figure 5C:
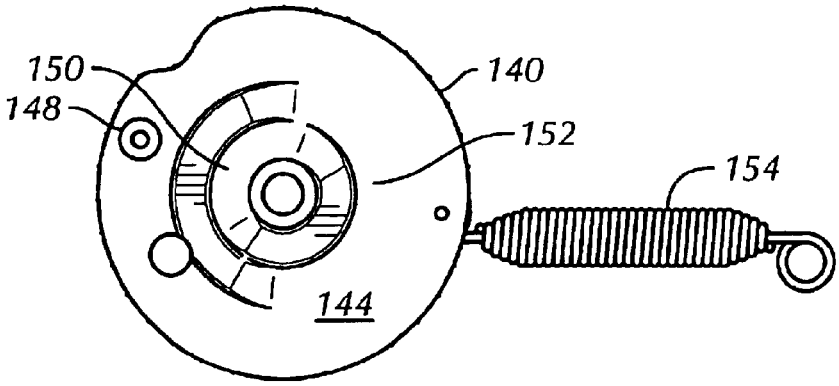
FIG. 5C is a side elevational view of a second side of the rotary member and biasing member of the lift mechanism of FIG. 5A.
Figure 6:
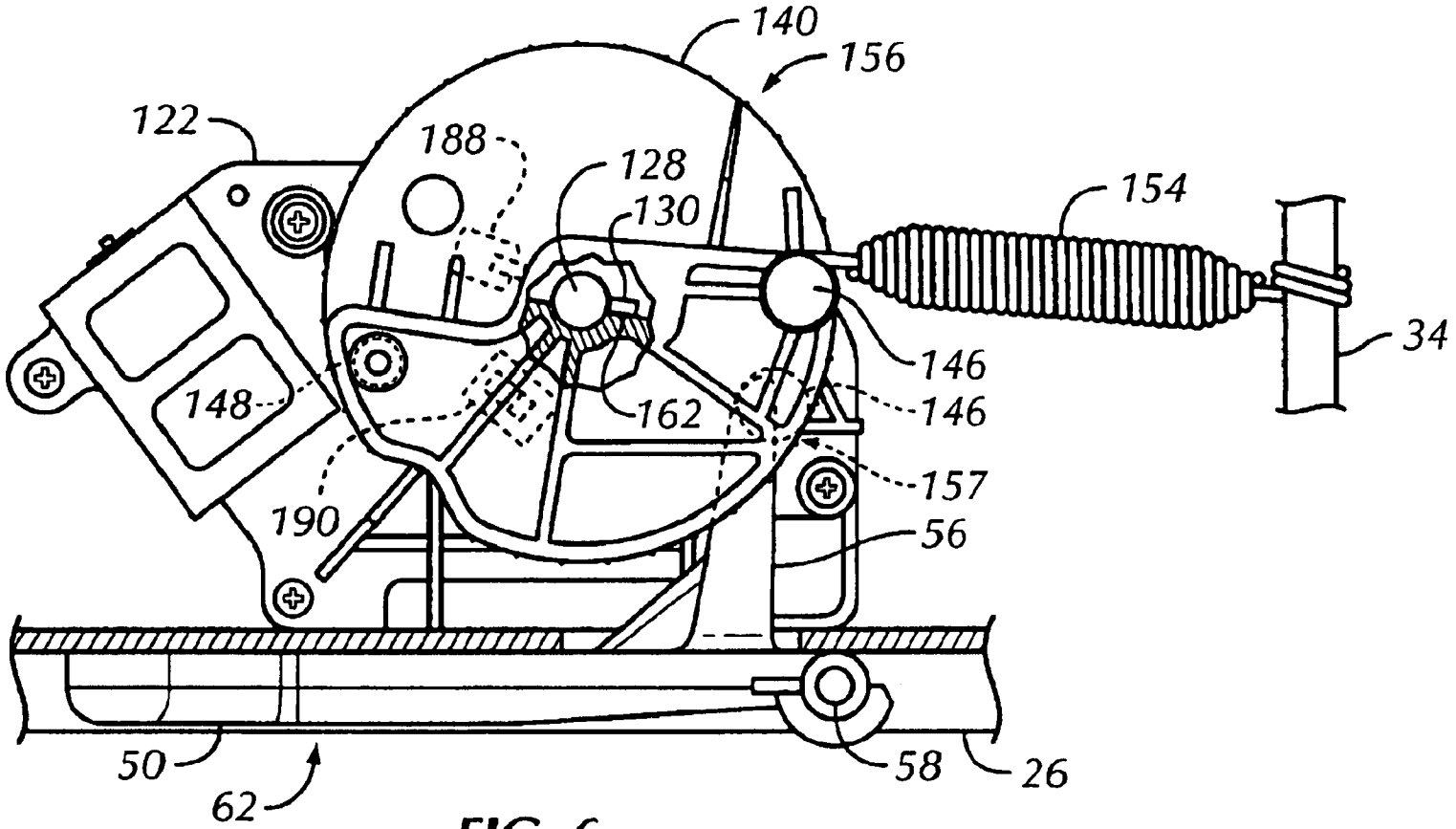
FIG. 6 is a side elevation view of elements of the lift mechanism and of a lifting lever of the toy vehicle of FIG. 1, showing the rotary member and biasing member in an unloaded position.
Figure 7:
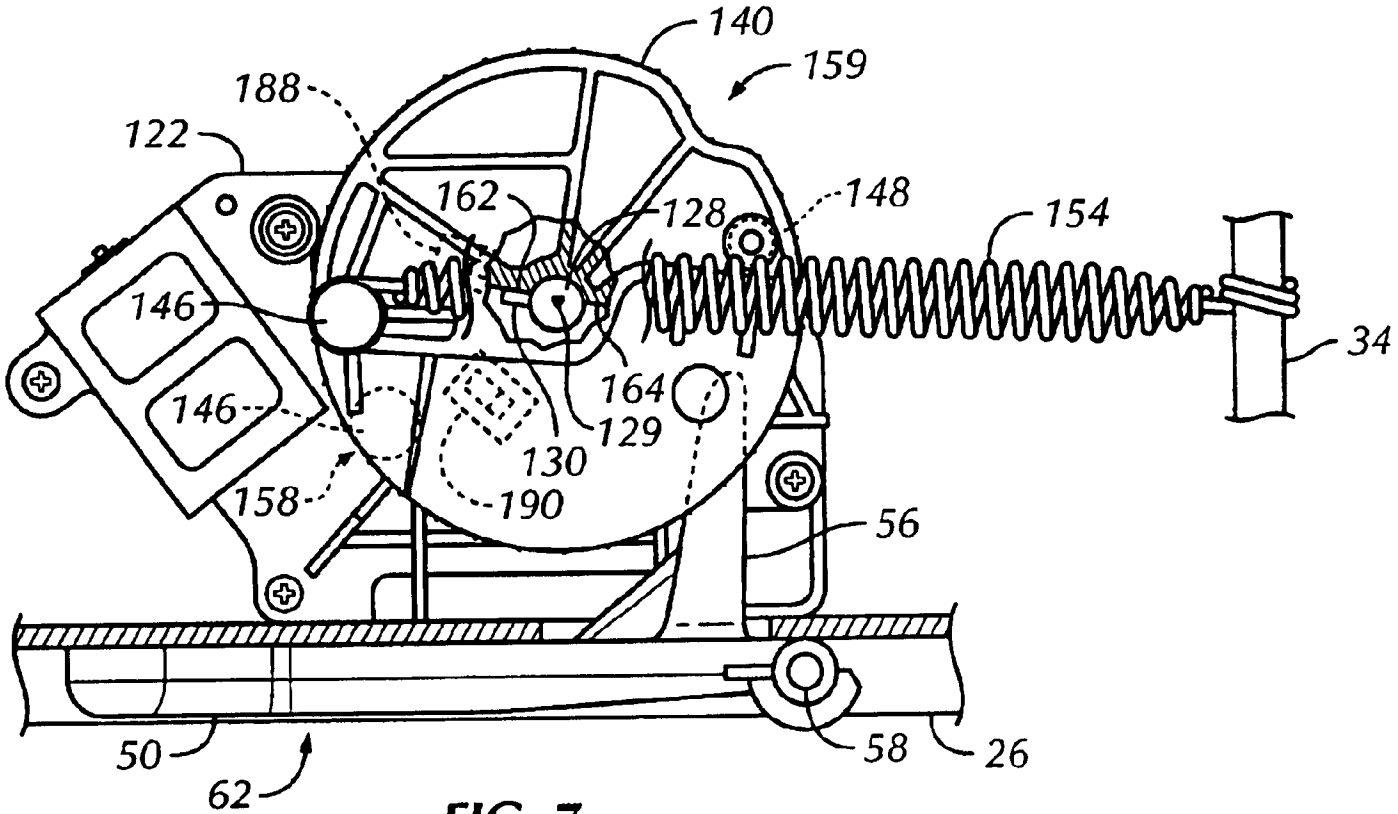
FIG. 7 is a side elevational view of elements of the lift mechanism and of the lifting lever of FIG. 6, showing the rotary member and biasing member in a preloaded or prerelease and in the release positions.
Figure 8:
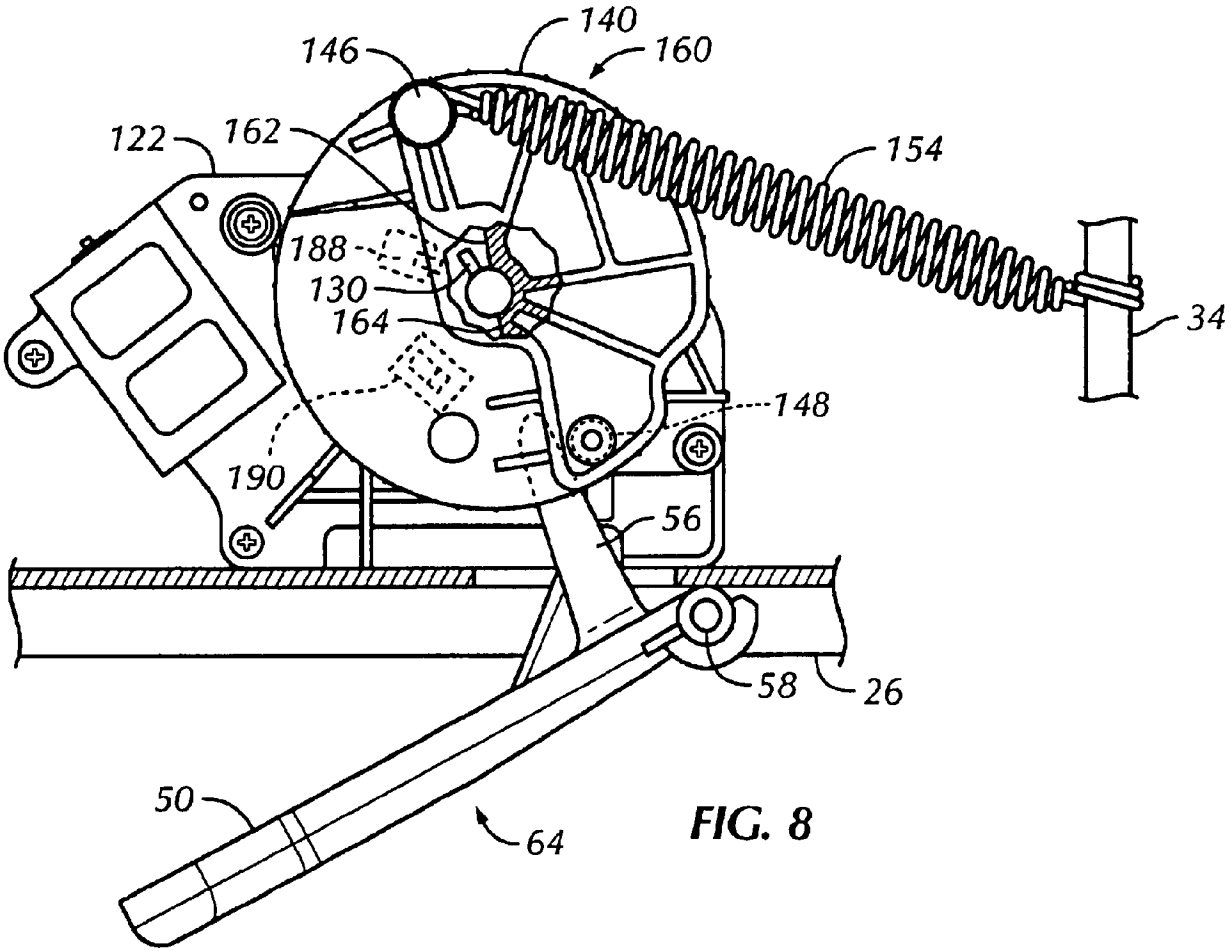
FIG. 8 is a side elevational view of elements of the lift mechanism and of the lifting lever of FIG. 6, showing the rotary member engaged with the lifting lever to move lifting lever into an extended position.

With particular reference to FIGS. 5A–5C, in a presently preferred embodiment the rotary member 140 is generally circular and disk-like in shape. The rotary member 140 has a first side 142 and a second side 144. An anchor pin 146 is provided on the first side 142 and located proximal an outer circumference of the rotary member 140. A second biasing member 154, preferably a coil spring, has a first end operably coupled with rotary member 140 by being secured with the anchor pin 146, while a second, oppressing end is coupled with chassis 20 by being attached to spring anchor 34. The second biasing member or spring 154 applies a tensile biasing force to the rotary member 140. From this disclosure, the artisan will recognize that other types of biasing members, for example, an elastic member or a resiliently flexible yoke, could be substituted for the spring 154. The artisan will further recognize that alternatively a second biasing member, located on an opposite side (that is, still on first side 142, but rotated 180 degrees) of the rotary member 140 (as seen in FIGS. 6–8) and applying a compressive force, could be substituted for the spring 154. Such biasing members creating a compressive force would include, for example, leaf springs, compression springs or compression cylinders. From this disclosure, the artisan will further recognize that the rotary member 140 need not be disk-like in shape. Other forms of rotary members or cams, including rotating arms or semi-circular shaped members, could be substituted.

With particular reference to FIGS. 5A and 5B, the rotary member 140 includes a central axial opening 141 through which output shaft 128 (operatively connected to the lift motor 124) is inserted. The output shaft 128 has a central longitudinal axis 129. A slot is provided in the rotary member 140 adjacent to the central opening 141 and between the sides 142, 144. Arcuate ends of the slot are defined by a first stop surface 162 and a second stop surface 164. The rotary member 140 is mounted for rotation both with and relative to the output shaft 128. With particular reference to FIGS. 4 and 6–8, the rotary member 140 is retained on the output shaft 128 by a stop member, preferably in the form of a pin 130, which has a longitudinal axis 131 and which is press fit transversely into the output shaft 128 to extend laterally beyond an outer circumferential surface of the output shaft 128. The pin 130 moves within the slot 166 such that the rotary member 140 freely rotates relative to the output shaft 128 until the pin 130 engages either the first stop surface 162 or the second stop surface 164. Preferably, the first and second stop surfaces 162, 164 are located approximately 180 degrees apart, and thus the rotary member 140 is freely rotatable relative to the output shaft 128 through an angle of approximately 180 degrees. This angle is suggestedly sufficient to enable the rotary member 140 to rotate freely from the release position 159 at least back to the relax position 156 but prevent further rotation to and/or through the park position 157. The arcuate slot may be or may somewhat be less or longer than 180 degrees, depending upon relative positions of release, relax and park positions and rotational speed of shaft 128.

With particular reference now to FIGS. 5B and 5C, on the second side 144 of rotary member 140, an actuating pin 148 is provided proximal the outer circumference and is spaced approximately 180 degrees from the anchor pin 146. Furthermore, a first cam surface 150 and a second cam surface 152 are provided extending axially outwardly on the second side 144. Operation of the actuating pin 148 and of the first and second cam surfaces 150, 152 is described in detail herein below.

With reference now to FIG. 9, electronic components associated with the electronic circuitry 170 of the toy vehicle 10 are indicated diagrammatically mounted on and off circuit board 171. The electronic circuitry 170 includes elements typically found in the electronic circuitry of wireless controlled (e.g. radio controlled) toy vehicles, including wireless signal (e.g. radio) receiver circuitry 172 and control circuitry indicated generally at 174, each operatively connected to the power source 200 either directly or indirectly. The receiver circuitry 172 is adapted to receive and preferably to decode command signals from a wireless transmitter 210 to provide control signals (e.g. forward, backward, left, right, lift) that can be sent to the control circuitry 174. The control circuitry 174 preferably further includes a microprocessor-based controller 175, and a dedicated linear drive motor control circuit 176, steering drive motor control circuit 178 and lift motor control circuit 180. Any or all of the motor control circuits may be coupled with the microprocessor 175 as shown in solid or directly with the receiver circuitry 172 as shown in phantom, if the receiver circuitry 172 is configured to generate and output properly decoded individual control signals. An on/off switch 182 operates to connect or isolate the power supply 200 from the remainder of the circuit. As will be further described, it may be used to set the angular position of output shaft 128 and rotary member 140 when the vehicle 10 is turned off. A park switch 190 and a preload switch 188, the operation of which is described below, are also operatively connected to the lift motor, either through the control circuitry 174 as indicated diagrammatically in solid or directly as indicted in phantom at "B" and "C".

The toy vehicle 10 preferably includes one or more circuit components (e.g. switches and/or other forms of sensors) to permit operation of the lift mechanism only if certain conditions associated with normal operation of the toy vehicle 10 are satisfied. More specifically, the toy vehicle 10 preferably includes a first condition sensor in the form of a weight-controlled switch (or "weight switch") 184 (see FIGS. 3, 4 and 9) to determine if a road wheel is bearing weight of the toy vehicle 10 as it would in normal running operation on surface 12. In a preferred embodiment, weight switch 184 is a microswitch mounted to the upper chassis housing 22 proximate one of the front wheels, for example, the left front wheel 70*a*, adjacent to the respective (i.e., left) kingpin 100*a*. Left front wheel 70*a*, including left kingpin 100*a*, is biased downwardly away from the vehicle chassis 20 by a spring (not shown). When the toy vehicle 10 is resting on its road wheels 70, 80 (with the lifting lever 50 facing toward the supporting surface 12), the weight of the toy vehicle 10 displaces the weight switch 184 downward and onto the left kingpin 100*a*, thereby engaging the left kingpin 100*a* and the weight switch 184 and actuating (e.g. closing) the weight switch 184. When the toy vehicle 10 is not resting on its wheels 70, 80 (that is, with the lifting lever 50 not facing toward the supporting surface), the spring (not shown) biases the left front wheel 70*a* and left kingpin 100*a* outwardly away from the chassis and out of engagement with the weight switch 184. Thus, status of the weight switch 184 serves as an indication that the toy vehicle 10 is resting on a supporting surface 12 on at least one or more of its road wheels. This is a conventional vehicle operating state for proper operation of the lift mechanism.

The toy vehicle 10 suggestedly further includes a second condition sensor, preferably a motion sensor 185, to provide a further indication that the toy vehicle 10 is in a proper operational position or state prior to activation of the lift mechanism. The motion sensor 185 includes wheel insert 76 in the left front wheel 70*a*. When the left front wheel 70*a* is rotating, the wheel insert 76 presents an alternating light and dark pattern when viewed from an interior side of the left front wheel 70*a*. The motion sensor 185 further preferably includes an optical detector 186 adapted to detect presence of such an alternating light and dark pattern. Thus, when the left front wheel 70*a* is rotating, the optical detector 186 provides a fifty percent duty cycle signal, the frequency of which is directly related to wheel rotation and toy vehicle speed. Sufficient vehicle speed is a further indication that the toy vehicle 10 is in a proper condition to allow activation of the lift mechanism. While each sensor 184, 185 may be separately connected with the control circuitry 174, their outputs may be combined into a single signal (as indicated by phantom connection "D") to provide a single, composite signal to the control circuitry 174. For example, the motion sensor 185 may provide an alternating ON-OFF signal, the peak voltage level of which can be changed by closure of the weight switch 184.

In summary, operation of the lift mechanism occurs as the lift motor 124 operatively engages with the rotary member 140 to rotate the rotary member 140 to a release position, i.e., a "cam-over" or "over center" position where the centerline of the second biasing member 154 rises above the center of the shaft 128 (i.e. above central longitudinal axis 129 of shaft 128). At that point, the second biasing member 154 causes the rotary member 140 to abruptly move out of operative engagement with the pin 130 and thus lift motor 124 and into operative engagement with the lifting lever 50. In particular, actuating pin 148 contacts actuating arm 56. The second biasing member 154 thus provides through the rotary member 140 the force moving the lifting lever 50 into the extended position 64. In the extended position, the lifting lever 50 engages the supporting surface 12 and the toy vehicle 10 is lifted away from the supporting surface 12 in a lifting motion. The rotary member 140 continues to rotate (clockwise in FIGS. 6–8) out of engagement with the lifting lever 50, and the lifting lever 50 is moved back into the retracted position 62 by the first biasing member 60. A more detailed description of the control and operation of the lift mechanism follows.

FIGS. 6–8 depict various operational angular positions of the rotary member 140. FIG. 6 depicts an initial "relaxed" position 156 (approximately 3:00 o'clock position of spring anchor 146 in solid), where the second biasing member/spring 154 is at its minimum extension, and a "park" position 157 (approximately 4:00 o'clock phantom position of anchor 146) where the second biasing member/spring 154 is slightly clockwise and relatively extended from the "relax" position 156. FIG. 7 depicts a "preload" or "pre-release" position 158 of the rotary member (the approximately 8:00 o'clock phantom position of the anchor 146) and a release position 159 (the approximately 9:00 o'clock solid position of the anchor 146). FIG. 8 depicts lifting lever 50 actuating position 160 of the rotary member 140 (about 11:00 position of the anchor 146). The control circuitry 174, preferably the controller 175, can determine these rotary positions of the rotary member through the states of the preferably normally open preload and park switches 188 and 190, which change states (i.e. close) through interaction with the first and second cam surfaces 150, 152. Specifically, the preload switch 188 is closed by contact with first cam surface 150 beginning between about the 2 and 3 o'clock positions of anchor 146 and ending between about the 7 and 8 o'clock position of the anchor 146 as the rotary member 140 rotates in the clockwise direction in FIGS. 6 and 7. The park switch 190 is closed by contact with the second cam surface 152 beginning at about the 4:00 o'clock position of anchor 146 and ending at about the 11:00 position. Thus, the park position 157 is indicated by the closure of park switch 190 after closure of the preload switch 188 when the rotary member 140 is being rotated clockwise. The preload position 158 is identified by the subsequent loss of signal from the preload switch 188 at about the 8 o'clock position. The loss of signal from the park switch 190 at about the 11:00 position indicates the rotary member 140 has engaged and deployed the lifting lever 50. Controller 174 monitors the state of switches 188, 190 to operate lift motor 124 to reengage the lift motor 124 with the rotary member 140 after a lift/jump maneuver and to rotate the rotary member 140 to the desired angular position for the next operation of the lift mechanism.

Operation and control of the lift mechanism is as follows. With continued reference to FIGS. 6 and 7, when the toy vehicle 10 is turned off, the rotary member 140 is preferably located in the park position 157. The on/off switch 182 is used to turn on the toy vehicle 10 and the control circuitry 174 begins to monitor the status of the weight switch 184 and motion sensor 185. When the control circuitry 174 observes that the vehicle 10 is in proper operation condition or state for lift operation (i.e. weight switch loaded/closed and minimum predetermined wheel speed reached), the control circuitry 174 activates the lift motor 124 to rotate the rotary member 140 clockwise into the "preload" position 158 (phantom in FIG. 7), wherein the spring 154 is near its maximum extension but is still holding the first stop surface 162 firmly against pin 130. The rotary member 140 is automatically moved into the preloaded position 158 in order to reduce the amount of time required for the lift mechanism to react to a subsequent lift command initiated by the user. As the member 140 is rotated (clockwise) from the park position 157 into the preload position 158, the preload switch 188 loses contact with the second cam surface 152 and opens, signaling the control circuitry 174 to cease operation of the lift motor 124.

The user initiates movement of the lifting lever 50 by operation of a jump switch (not shown) on the wireless transmitter 210. The wireless transmitter 210 transmits a unique, discrete signal to initiate the jump function. Other functions (for example, operation of the linear drive motor 110 or operation of the steering motor 92) may be overridden and disabled when the jump function is enabled. Provided that the rotary member 140 is already in the preload position 158, then operation of the lift motor 124 is initiated. If the rotary member has not begun movement from the park position 157, nothing happens when the lift/jump command is transmitted.

With reference now to FIG. 7, if the vehicle 10 receives the lift command with the rotary member 140 in the preload position 158, the control circuitry 174 activates the lift motor 124 to rotate the rotary member 140 in a clockwise direction from the preload position 158 (phantom) into the actuating or release or cam-over or over-center position 159 (solid). The release position 159 exists slightly clockwise of the preloaded position 158 (at or just past 9 o'clock position of the anchor 146), wherein the force vector of spring 154 (connecting the upper chassis spring anchor 34 to the rotary member spring anchor 146) moves from below the central longitudinal axis 129 of the output shaft 128 to just above the central longitudinal axis 129. The torque on the rotary member 140 due to the spring 154 changes from being counterclockwise (and resisted by the lift motor 124 via pin 130 bearing against the first stop surface 162) to being clockwise. The rotary member 140 is free to rotate relative to the output shaft 128 when a clockwise torque is applied in position 159. As the rotary member 140 moves past the release position 159, the rotary member 140 is abruptly pulled clockwise out of operative engagement with the pin 130 and motor 124 (through separation of stop surface 162 from pin 130) and back toward the relax and park positions 156, 157. Movement of the pin 130 within the slot defined by first and second stop surfaces 162, 164 thus acts to clutch the rotary member 140 out of engagement with the lift motor 124.

Referring now to FIG. 8, during this abrupt motion, the actuating pin 148 engages the lifting lever actuating arm 56, pivoting the lifting lever 50 from the retracted position 62 into the extended position 64. In doing so, the lifting lever free first end 52 strikes the supporting surface 12, propelling the toy vehicle 10 in a lifting motion. As the rotary member 140 continues to rotate towards the relaxed and park positions 156, 157, the actuating pin 148 rotates out of engagement with the lifting lever actuating arm 56, and the first biasing member 60 moves the lifting lever 50 back into the retracted position 62.

The weight distribution of the toy vehicle 10 as well as the magnitude and direction of the force generated by the lifting lever 50 can be tailored such that the resultant force acting on the toy vehicle 10 during the lifting motion tends to cause the toy vehicle 10 not only to lift vertically from the supporting surface 12, but to also flip forward, back end over front end over back end, through at least a full 360 degree flip. The toy vehicle 10 thus is adapted to perform a combined lifting and flipping motion.

After release of the rotary member 140, the control circuitry continues to operate the lift motor 124 to rotate in a clockwise direction until the pin 130 reengages the first stop surface 162 in or around the relaxed position 156 and preferably continues to rotate until it moves the rotary member 140 into the park position 157. If the predetermined operational states are again present (weight on weight switch and minimum speed of left front wheel 70*a*), the control circuitry 174 will move the rotary member 140 back to the prerelease position 158 for another lifting operation.

If the vehicle 10 is stationary for a predetermined period of time (for example, two minutes), the control circuitry 174 can be configured to cause the lift motor 124 to rotate backwards (i.e. in a counterclockwise direction as seen in FIGS. 6–8) to rotate the rotary member 140 back into the park position 157. If the vehicle 10 is again driven and the weight load/wheel speed preconditions for lift operation are again met, the rotary member 140 can be rotated back to the preload position 158. Similarly, when the toy vehicle 10 is turned off, through on/off switch 182, the rotary member 140 is preferably returned to the park position 157. In both instances, this operation reduces the duration of mechanical stress on components of the toy vehicle 10 resulting from the spring 154 being in tension. Preferably, when the vehicle 10 is turned off, the rotary member 140 is returned to the park position 157 through interaction of the on/off and park switches 182, 190. This is accomplished by wiring the park switch 190 in series with the power supply 200 and the reverse drive circuit of the lift motor 124 through a second pole 182*a* of on/off switch 182. When the on/off switch 182 is moved to the off position, pole 182*a* connects the power supply to ground through the reverse drive circuit of lift motor 124, which includes the park switch 190. When the motor rotates backwards (counterclockwise) through the park position 157, the park switch 190 opens, breaking the circuit and stopping motor 124. Since the preload and park switches indicate various angular positions of the rotary member 140, the microprocessor 175 can be programmed to perform other functions including reset of the rotary member initial position and diagnosis of jamming of the output shaft 128.

From the foregoing it can be seen that the present invention comprises a new toy vehicle design having a novel lift mechanism capable of producing an unusual lifting action as well as safety features to help prevent hazardous operation of the lift mechanism.

It will be appreciated by those skilled in the art that changes could be made to the embodiment described above without departing from the broad inventive concept thereof. For example, although the embodiment discussed above refers to actuation of the lift mechanism by initiation of a remote control signal, other modes of initiation could be used. For example, the lift mechanism could be actuated upon driving the vehicle in a forward direction for a period of time or until a certain speed is reached or until the vehicle had been driven in any direction for a pre-determined period of time or was commanded to perform a particular maneuver. Although the invention is described herein in terms of the preferred, four-wheeled embodiments, the present invention could also comprise a vehicle having three wheels, or more than four wheels. The toy vehicle 10 is preferably controlled via radio (wireless) signals from the wireless transmitter 210. However, other types of controllers may be used including other types of wireless controllers (e.g. infrared, ultrasonic and/or voice-activated controllers) and even wired controllers and the like. The vehicle 10 can be constructed of, for example, plastic or any other suitable material such as metal or composite materials. Also, the dimensions of the toy vehicle 10 shown can be varied, for example making components of the toy vehicle smaller or larger relative to the other components. It is understood, therefore, that this invention is not limited to the particular embodiment disclosed, but it is intended to cover modifications within the spirit and scope of the appended claims.

We claim:

1. A toy vehicle comprising:

a vehicle chassis;

a plurality of road wheels supporting the vehicle chassis for movement across a supporting surface;

a power source supported by the vehicle chassis;

a vehicle lift mechanism supported by the vehicle chassis and including:

a rotary member;

a lift motor operatively connected to the power source and to the rotary member;

a lifting lever hingedly attached to the vehicle chassis, so as to pivot between a retracted position and an extended position;

a first biasing member positioned to bias the lifting lever into the retracted position; and a second biasing member operably coupled to the rotary member;

wherein the lift motor operatively engages with the rotary member to rotate the rotary member into a release position where the second biasing member causes the rotary member to move out of operative engagement with the lift motor and into operative engagement with the lifting lever, the second biasing member moving the lifting lever into the extended position through the rotary member, whereby the lifting lever engages the supporting surface and the toy vehicle is lifted away from the supporting surface in a lifting motion.

2. The toy vehicle of claim 1 wherein weight distribution of the vehicle is balanced such that forces acting on the vehicle during the lifting motion cause the toy vehicle to flip end-over-end.

3. The toy vehicle of claim 1 wherein the first biasing member is a torsion spring.

4. The toy vehicle of claim 1 wherein the second biasing member is a coil spring.

5. The toy vehicle of claim 1 wherein the second biasing member applies a tensile force to the rotary member.

6. The toy vehicle of claim 1 wherein the lifting lever is hingedly attached to a bottom surface of the vehicle chassis.

7. The toy vehicle of claim 1, wherein:

the lift mechanism further comprises a gear train coupled with the lift motor and an output shaft driven by the gear train, the output shaft having a central longitudinal axis and a stop member extending generally transversely from the output shaft;

the rotary member includes a first stop surface and a second stop surface spaced from the first stop surface; and the rotary member is mounted to the output shaft for free rotation relative to the output shaft between engagement of the stop member with the first stop surface and the second stop surface.

8. The toy vehicle of claim 7, wherein the rotary member rotates freely relative to the output shaft between the first stop surface and the second stop surface through an angle of about 180 degrees or more.

9. The toy vehicle of claim 1 further comprising electronic circuitry operatively connected to the power source and to the lift motor.

10. The toy vehicle of claim 9 further comprising a first sensor operatively coupled with the electronic circuitry to control a first operation of the lift motor.

11. The toy vehicle of claim 10 further comprising a second sensor operatively coupled with the electronic circuitry to control a second operation of the lift motor.

12. A combination comprising a remote control device with a wireless transmitter and the toy vehicle of claim 9, wherein toy vehicle electronic circuitry includes a remote control receiver and is adapted to at least receive and decode wireless control signals from the wireless transmitter.

13. The toy vehicle of claim 9 further comprising a switch operatively connected to the electronic circuitry to prevent operation of the vehicle lift mechanism, except under a predetermined state of the switch.

14. The toy vehicle of claim 13 wherein the switch permits operation of the vehicle lift mechanism only when in a state indicating a conventional operating condition of the toy vehicle on the supporting surface.

15. The toy vehicle of claim 9 further comprising and a switch configured to detect a force applied to at least one of the road wheels by contact of at least one of the road wheels with the supporting surface.

16. The toy vehicle of claim 9 further comprising a sensor operatively connected with the electronic circuitry to permit operation of the lift mechanism only under a predetermined state of the vehicle sensed by the sensor.

17. The toy vehicle of claim 16 wherein the sensor permits operation of the lift mechanism only after the vehicle has moved across the supporting surface sufficiently to indicate vehicle operation on the supporting surface.

18. The toy vehicle of claim 16 further comprising wherein the sensor detects rotation of the at least one of the road wheels.

* * * * *